US010332393B1

(12) United States Patent
Chang et al.

(10) Patent No.: US 10,332,393 B1
(45) Date of Patent: Jun. 25, 2019

(54) EMERGENCY TRAFFIC CONTROLLER FOR EMERGENCY VEHICLES AND CONTROLLING METHOD THEREOF

(71) Applicants: LITE-ON ELECTRONICS (GUANGZHOU) LIMITED, Guangzhou (CN); LITE-ON TECHNOLOGY CORPORATION, Taipei (TW)

(72) Inventors: Kuo-Hui Chang, Taipei (TW); Yao-Chi Peng, Taipei (TW); Po-Chang Li, Taipei (TW); Ming-Hung Chien, Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 15/877,465

(22) Filed: Jan. 23, 2018

(51) Int. Cl.

| | |
|---|---|
| ***G08B 21/00*** | (2006.01) |
| ***G08G 1/087*** | (2006.01) |
| ***G08G 1/095*** | (2006.01) |
| ***G08G 1/017*** | (2006.01) |

(52) U.S. Cl.
CPC ..... *G08G 1/087* (2013.01); *G08G 1/017* (2013.01); *G08G 1/095* (2013.01)

(58) Field of Classification Search
CPC ..... G08G 1/087; G08G 1/017; G08G 1/095
USPC ..... 340/917
See application file for complete search history.

(56) References Cited

U.S. PATENT DOCUMENTS

| | | | | | |
|---|---|---|---|---|---|
| 4,162,477 | A * | 7/1979 | Munkberg | G08G 1/087 | 327/136 |
| 4,223,295 | A * | 9/1980 | Bonner | G08G 1/087 | 340/906 |
| 4,443,783 | A | 4/1984 | Mitchell | | |
| 4,704,610 | A * | 11/1987 | Smith | G08G 1/087 | 340/906 |
| 5,977,883 | A * | 11/1999 | Leonard | G08G 1/087 | 340/902 |
| 2014/0368111 | A1* | 12/2014 | Hebborn | H05B 41/2925 | 315/76 |

* cited by examiner

*Primary Examiner* — Mark S Rushing
(74) *Attorney, Agent, or Firm* — McClure, Qualey & Rodack, LLP

(57) ABSTRACT

A novel emergency traffic controller for emergency vehicles and a controlling method thereof are provided. The emergency traffic controller includes an emergency controlling unit, a target redirection unit and a source selection unit. The emergency controlling unit is used for receiving an emergency message and outputting a switching signal according to the emergency message. The target redirection unit is electrically coupled to an existing traffic light controller and the emergency controlling unit. The source selection unit is electrically coupled to the traffic light controller. The target redirection unit is used for receiving a lighting signal from the existing traffic light controller through the source selection unit and working with the emergency controlling unit to transmit the lighting signal to one of a plurality of traffic light signs according to the switching signal.

18 Claims, 6 Drawing Sheets

EMERGENCY TRAFFIC CONTROLLER FOR EMERGENCY VEHICLES AND CONTROLLING METHOD THEREOF

BACKGROUND OF THE INVENTION

Field of the Invention

The invention relates in general to a controller and a controlling method thereof, and more particularly to an emergency traffic controller for emergency vehicles and a controlling method thereof.

Description of the Related Art

In an intersection, the emergency vehicles, such as police car, ambulance, fire engine, may not pass through the intersection quickly and safely due to the red traffic light. Therefore, it may delay to save people or extinguish the fire.

In the past, the emergency vehicles may be forced to pass through the intersection to save time. However, the car accident is frequently happened on these vehicles when passing through the red traffic light. Therefore, it is needed to invent a novel emergency traffic controller for emergency vehicles.

SUMMARY OF THE INVENTION

The invention is directed to a novel emergency traffic controller for emergency vehicles and a controlling method thereof. When the novel emergency traffic controller is operated in an emergency mode, traffic light signs are controlled for the emergency vehicle to safely and quickly pass through the intersection. Further, the novel emergency traffic controller can be set up without modifying the structure or circuit design of the existing traffic light controller and the traffic light sign, so the novel emergency traffic controller can be adapted to any traffic light system in any country. Moreover, after the emergency vehicle passes through, the novel emergency traffic controller can return to a normal mode which will operate normally with lighting signals provided from the existing traffic light controller.

According to a first aspect of the present invention, an emergency traffic controller is provided. The emergency traffic controller includes an emergency controlling unit, a target redirection unit and a source selection unit. The emergency controlling unit is used for receiving an emergency message and outputting a switching signal according to the emergency message. The target redirection unit is electrically coupled to an existing traffic light controller and the emergency controlling unit. The source selection unit is electrically coupled to the traffic light controller. The target redirection unit is used for receiving a lighting signal from the existing traffic light controller through the source selection unit and working with the emergency controlling unit to transmit the lighting signal to one of a plurality of traffic light signs according to the switching signal.

According to a second aspect of the present invention, a controlling method of an emergency traffic controller is provided. The controlling method includes the following steps. A lighting signal is received from the existing traffic light controller. An emergency message is received. A switching signal is outputted according to the emergency message. The lighting signal is transmitted to one of a plurality of traffic light signs according to the switching signal.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
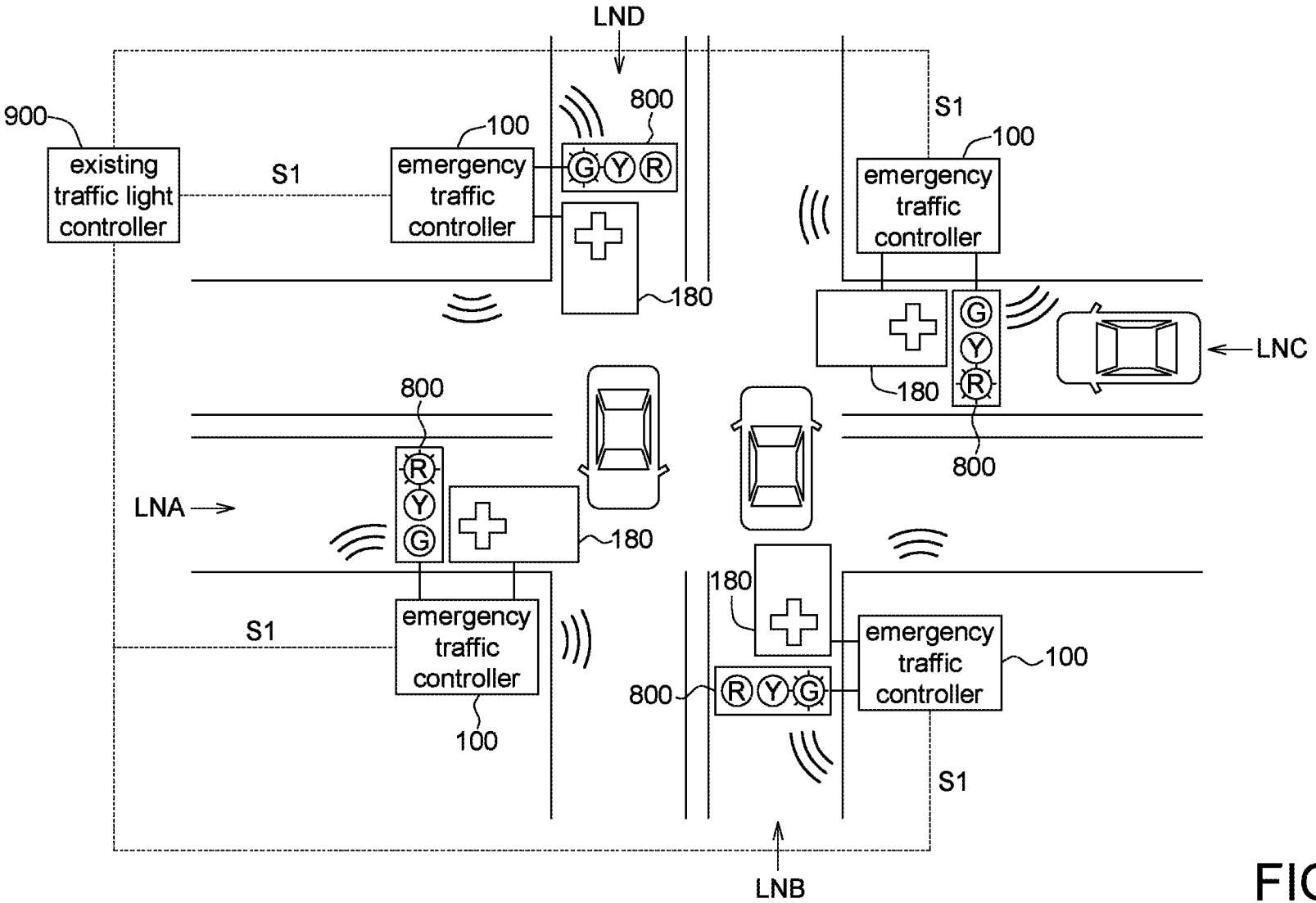
FIGS. 1 and 2 show several emergency traffic controllers according to one embodiment.
Figure 2:
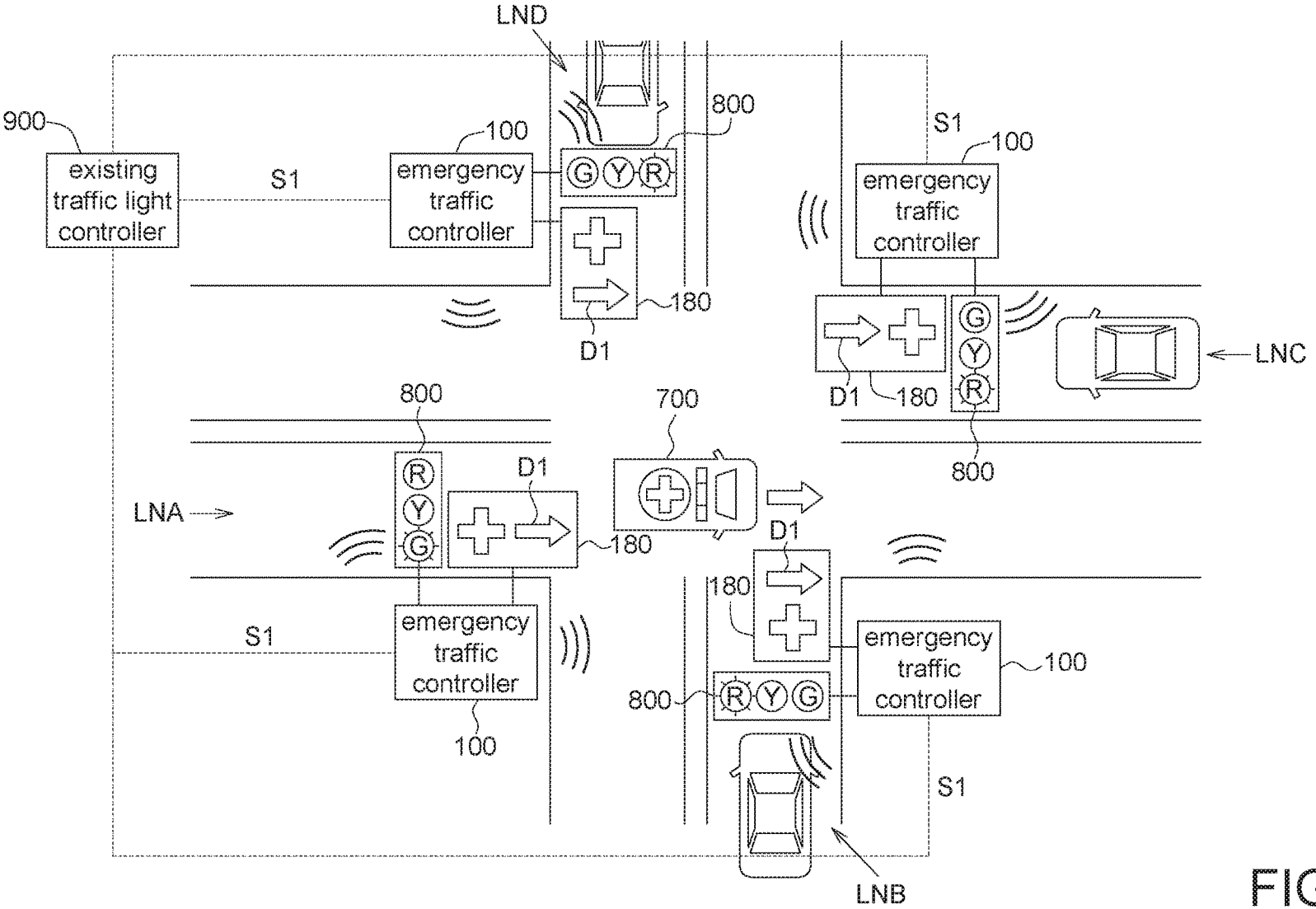

Please refer to FIGS. 1 and 2, several emergency traffic controllers 100 for an existing traffic light controller 900 according to one embodiment are shown. The existing traffic light controller 900 is used to generate four lighting signals S1 to four sets of traffic light signs 800 respectively. In each of the traffic light signs 800, "G" means "green", "Y" means "yellow" and "R" means "red." When the traffic light sign 800 turns on the green light, the vehicle is allowed to pass through the intersection; when the traffic light sign 800 turns on the red light, the vehicle is not allowed to pass through the intersection.

The emergency traffic controllers 100 are connected to the existing traffic light signs 800 respectively. The traffic light signs 800 can be controlled under a normal mode or an emergency mode. As shown in FIG. 1, in the normal mode, the traffic light signs 800 are controlled normally according to the time information. For example, the traffic light signs 800 at lanes LND, LNB turn on the green light, and the traffic light signs 800 at lanes LNA, LNC turn on the red light. Then, the traffic light signs 800 at lanes LND, LNB turn on the red light, and the traffic light signs 800 at lanes LNA, LNC turn on the green light.

As shown in FIG. 2, in the emergency mode, the traffic light signs 800 are controlled according to the movement of the emergency vehicle 700, such that the emergency vehicle 700 can safely and quickly pass through the intersection. For example, referring to FIG. 2, the emergency vehicle 700 moves on the lane LNA. The traffic light signs 800 at lane LNA turn on the green light, and the traffic light signs 800 at lanes LNB, LNC, LND turn on the red light. As such, the emergency vehicle 700 can safely and quickly pass through the intersection.

In this embodiment, the emergency traffic controller 100 is disposed between the existing traffic light controller 900 and the traffic light sign 800 without modifying the structure or the circuit design of the existing traffic light controller 900 and the traffic light sign 800. Therefore, the emergency traffic controller 100 can be adapted to any traffic light system in any country.

Figure 3:
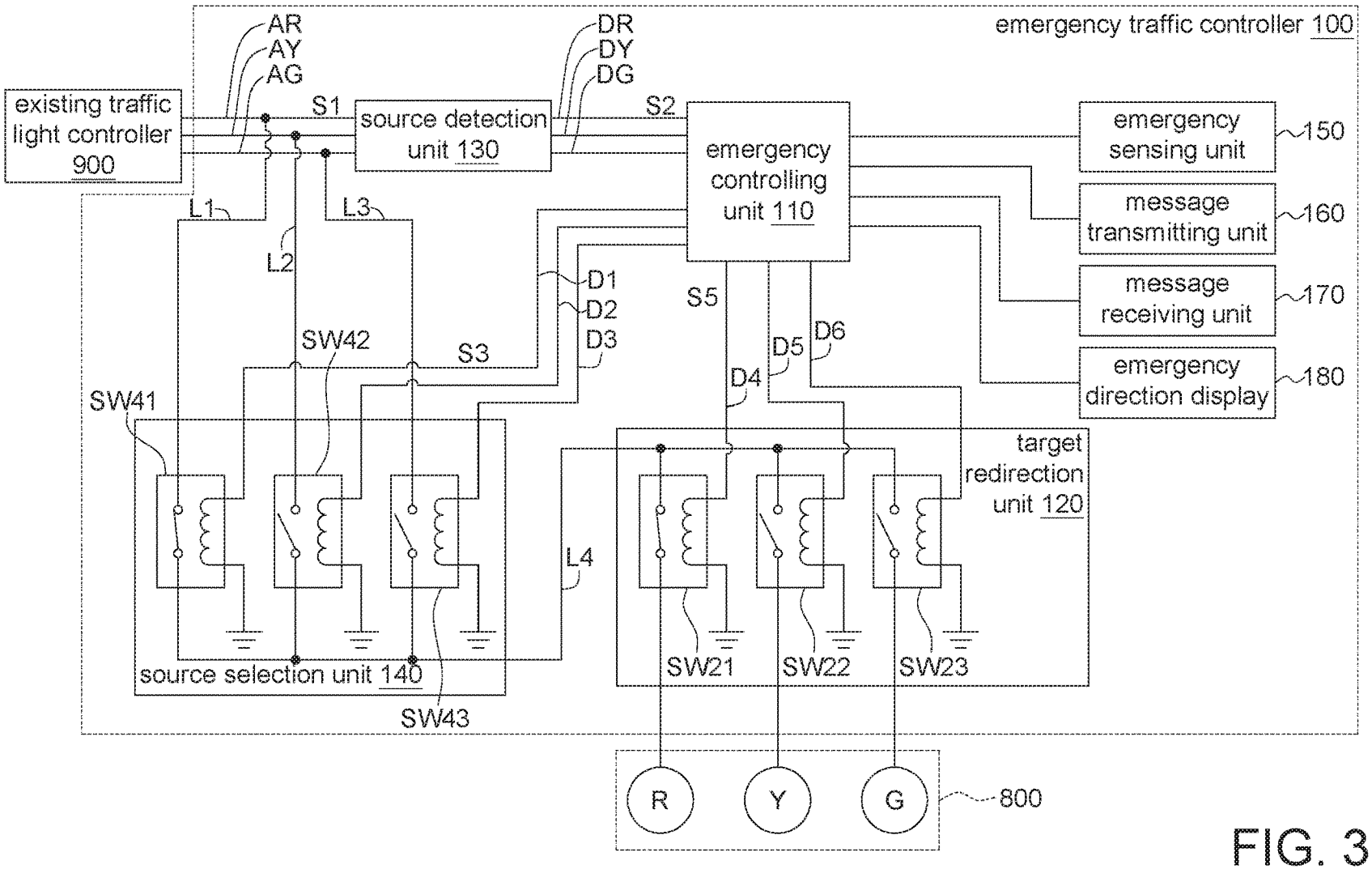
FIG. 3 shows the emergency traffic controller operated in the normal mode according to one embodiment.
Figure 4:
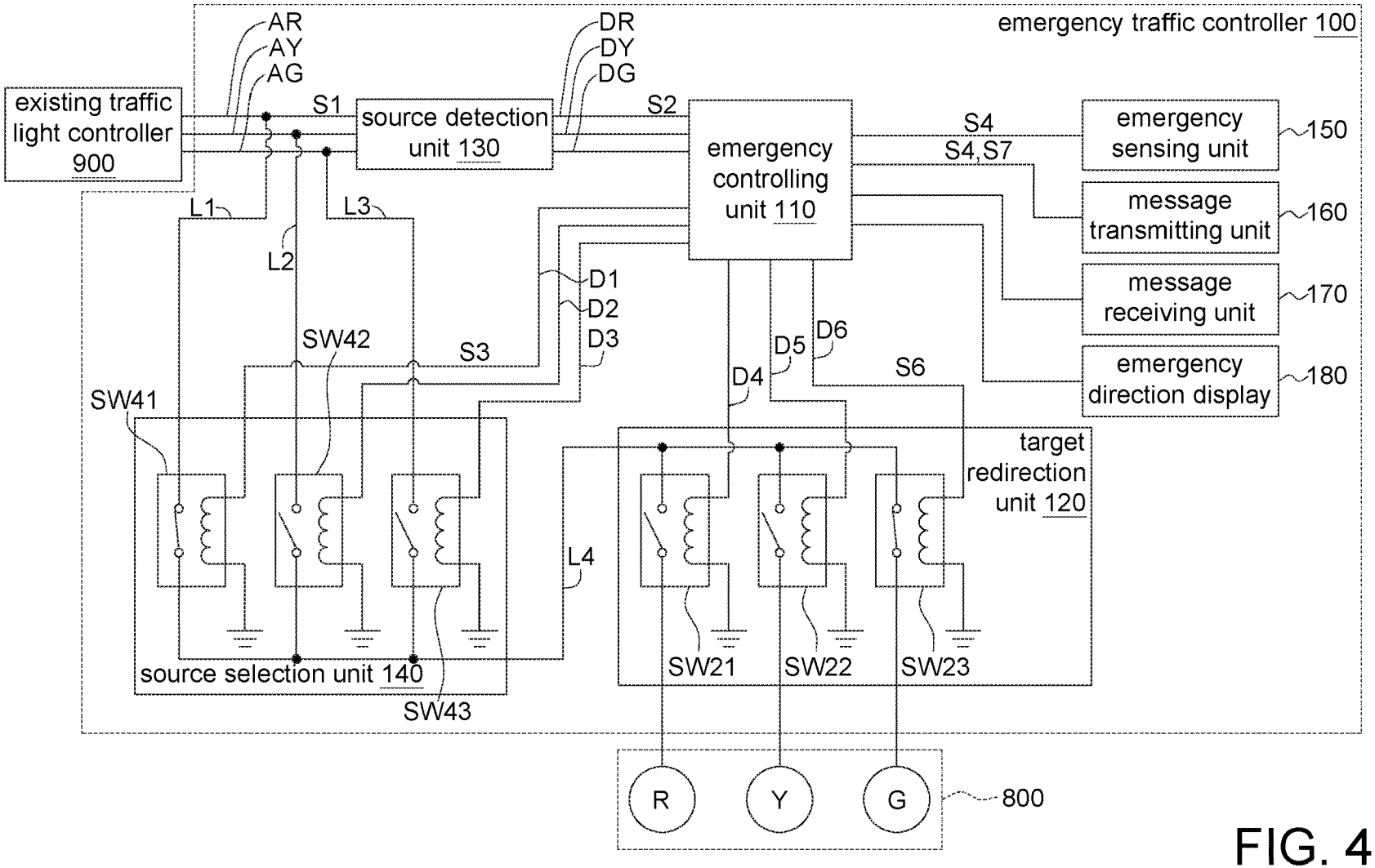
FIG. 4 shows the emergency traffic controller operated in the emergency mode according to one embodiment.

Please refer to FIGS. 3 and 4. FIG. 3 shows the emergency traffic controller 100 operated in the normal mode according to one embodiment. FIG. 4 shows the emergency traffic controller 100 operated in the emergency mode according to one embodiment. The emergency traffic controller 100 includes an emergency controlling unit 110, a target redirection unit 120, a source detection unit 130, a source selection unit 140, an emergency sensing unit 150, a message transmitting unit 160, a message receiving unit 170 and an emergency direction display 180. The target redirection unit 120 is electrically connected to the traffic light sign 800 and the emergency controlling unit 110. The source detection unit 130 is electrically connected to the existing traffic light controller 900 and the emergency controlling unit 110. The source selection unit 140 is electrically connected to the existing traffic light controller 900, the emergency controlling unit 110 and the source detection unit 130. Each of the emergency controlling unit 110, the target redirection unit 120, the source detection unit 130, and the source selection unit 140 may be a chip, a circuit, a circuit board, a firmware or a non-transitory computer readable medium storing a plurality of program codes. The emergency sensing unit 150 may be a camera, a sound detector, or a RFC receiver. Each of the message transmitting unit 160 and the message receiving unit 170 may be an antenna module or a transmission wire. The operation of those elements is illustrated with a flowchart.

Figure 5:
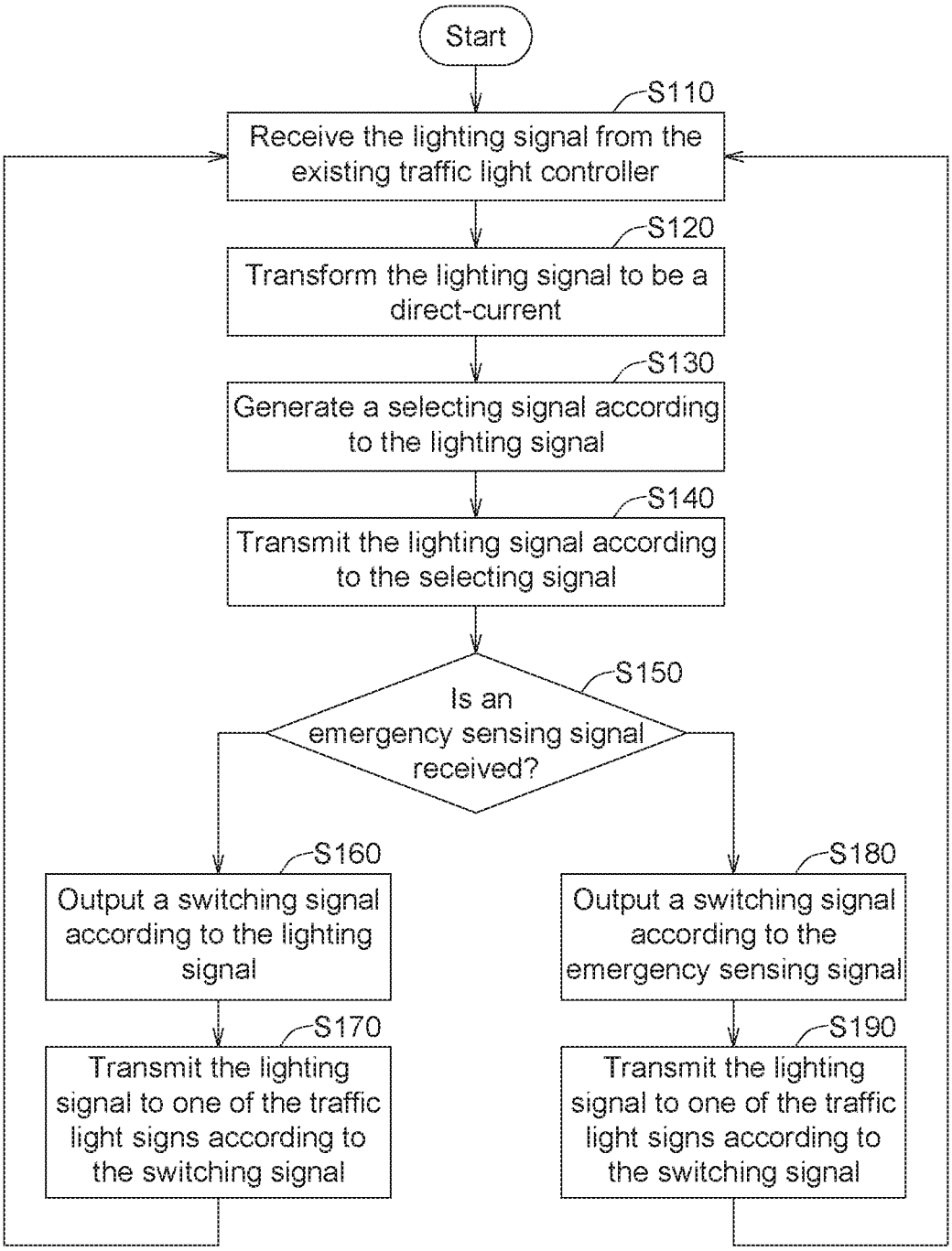
FIG. 5 which shows a flowchart of a controlling method of the emergency traffic controller according to one embodiment.

Please refer to FIG. 5, which shows a flowchart of a controlling method of the emergency traffic controller 100 according to one embodiment. In step S110, the source detection unit 130 receives the lighting signal S1 from the existing traffic light controller 900. For example, three lines AR, AY, AG connect the existing traffic light controller 900 and the source detection unit 130. For turning on the red light, the existing traffic light controller 900 transmits the lighting signal S1 via the line AR.

Then, in step S120, the source detection unit 130 transforms the lighting signal S1 to be a lighting signal S2 having a direct-current voltage level. In one embodiment, the lighting signal S1 may have an alternating current and the source detection unit 130 is an AC-DC converter for transforming the alternating-current to be a direct-current voltage level. Or, in one embodiment, the lighting signal S1 may have a high voltage direct-current and the source detection unit 130 is a DC-DC shifter for transforming the high voltage direct-current to be a low voltage direct-current. Three lines DR, DY, DG connect the source detection unit 130 and the emergency controlling unit 110. The source detection unit 130 transmits the lighting signal S2 to the emergency controlling unit 110 via the line DR.

Afterwards, in step S130, the emergency controlling unit 110 generates a selecting signal S3 according to the lighting signal S2. Three lines D1, D2, S3 connect the emergency controlling unit 110 and the source selection unit 140. The emergency controlling unit 110 transmits the selecting signal S3 to the source selection unit 140 via the line D1.

Then, in step S140, the source selection unit 140 transmits the lighting signal S1 according to the selecting signal S3. Three lines L1, L2, L3 connect the existing traffic light controller 900 and the source selection unit 140. The existing traffic light controller 900 transmits the lighting signal S1 to the source selection unit 140 via the line L1. In this embodiment, the source selection unit 140 includes a plurality of switches SW41, SW42, SW43. Each of the switches SW41, SW42, SW43 is a relay device, such as a magnetic switch. The lighting signal S1 is transmitted to the switch SW41, and the selecting signal S3 is transmitted to the switch SW41 too. The switch SW41 is turned on via the selecting signal S3, so the lighting signal S1 can be transmitted to the target redirection unit 120 via line L4.

Next, in step S150, the emergency controlling unit 110 determines whether an emergency message S4 (shown in FIG. 4) is received from the emergency sensing unit 150. The emergency sensing unit 150 is used for detecting whether there is an emergency vehicle 700 on a road. If the emergency vehicle 700 is detected, the emergency sensing unit 150 generates and transmits the emergency message S4 to the emergency controlling unit 110.

If the emergency controlling unit 110 does not receive the emergency message S4, then the normal mode is entered and the process proceeds to step S160; if the emergency controlling unit 110 receives the emergency message S4, then the emergency mode is entered and the process proceeds to step S180. The steps S160 and S170 of the normal mode are illustrated via FIG. 3; the steps S180 and S190 of the emergency mode are illustrated via FIG. 4.

In step S160 of the normal mode, as shown in FIG. 3, the emergency controlling unit 110 outputs a switching signal S5 according to the lighting signal S2. Three lines D4, D5, D6 connect the emergency controlling unit 110 and the target redirection unit 120. The emergency controlling unit 110 transmits the switching signal S5 to the target redirection unit 120 via the line D4.

In step S170 of the normal mode, the target redirection unit 120 transmits the lighting signal S1 to one of the traffic light signs 800 according to the switching signal S5. In the present embodiment, the target redirection unit 120 includes a plurality of switches SW21, SW22, SW23. The lighting signal S1 is transmitted to all of the switches SW21, SW22, SW23, and the switching signal S5 is transmitted to the switch SW21. The switch SW21 is turned on via the switching signal S5, so the lighting signal S1 can be transmitted to the traffic light sign 800 which is used to emit the red light. As such, in the normal mode, the traffic light signs 800 can be operated according to the control of the existing traffic light controller 900.

In step S180 of the emergency mode, as shown in FIG. 4, the emergency controlling unit 110 outputs a switching signal S6 according to the emergency message S4. The emergency controlling unit 110 transmits the switching signal S6 to the target redirection unit 120 via the line D6.

In step S190 of the emergency mode, the target redirection unit 120 transmits the lighting signal S1 to one of the traffic light signs 800 according to the switching signal S6. The lighting signal S1 is transmitted to all of the switches SW21, SW22, SW23, and the switching signal S6 is transmitted to the switch SW23. The switch SW23 is turned on via the switching signal S6, so the lighting signal S1 can be transmitted to the traffic light sign 800 which is used to emit the green light. As such, in the emergency mode, the traffic light signs 800 can be operated according to the control of the emergency traffic controller 100.

Moreover, referring to FIG. 4, when the emergency controlling unit 110 receives the emergency message S4, the emergency controlling unit 110 transmits the emergency message S4 and a notification message S7 to the message transmitting unit 160, and then the message transmitting unit 160 transmits the emergency message S4 and the notification message S7 to another emergency traffic controller 100. The notification message S7 may include the identification of this emergency traffic controller 100 and a moving direction D1 (shown in FIG. 2) of the emergency vehicle 700. The message receiving unit 170 of another emergency traffic controller 100 receives the emergency message S4 and the notification message S7 from this emergency traffic controller 100 and is operated in the emergency mode accordingly. Therefore, once one emergency traffic controller 100 detects the emergency vehicle 700, this emergency traffic controller 100 can inform other emergency traffic controllers 100 to be operated in the emergency mode at the same time.

For example, referring to FIG. 2, the emergency traffic controller 100 located on the lane LNA detects the emergency vehicle 700 and controls the traffic light sign 800 located on the lane LNA to be turned on the green light. At the same time, the emergency traffic controller 100 located on the lane LNA informs the emergency traffic controllers 100 located on the lanes LNB, LNC, LND, and the emergency traffic controllers 100 located on the lanes LNB, LNC control the traffic light signs 800 located on the lane LNB, LNC, LND to be turned on the red light.

Furthermore, referring to FIG. 2, in the emergency mode, the emergency direction display 180 displays the moving direction D1 of the emergency vehicle 700 according to the emergency message S4 or the notification message S7. When the drivers know the moving direction D1 of the emergency vehicle 700, the drivers can pay attention to the emergency vehicle 700 for prevent from the car accident.

Figure 6:
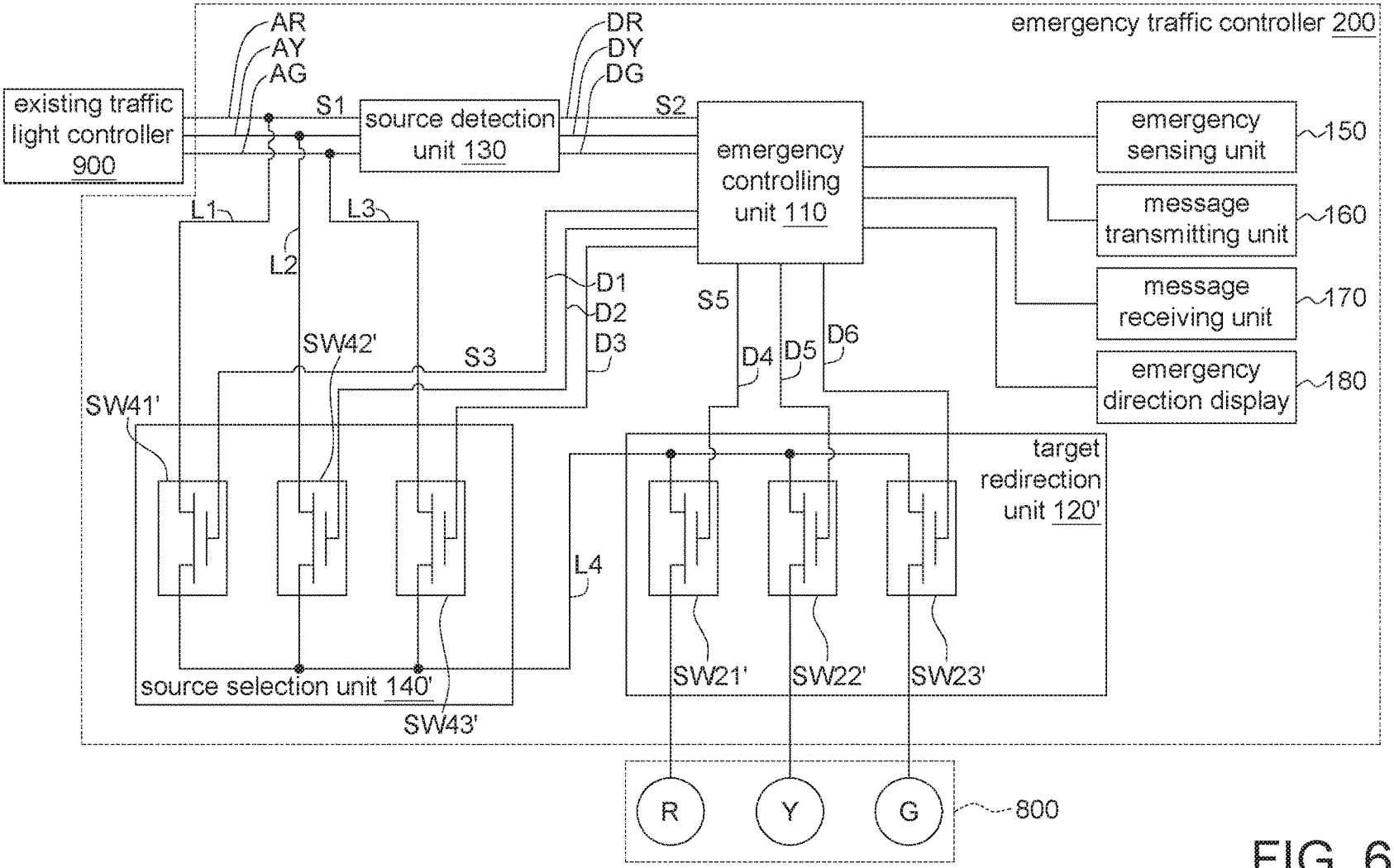
FIG. 6 shows another emergency traffic controller according to another embodiment.

In another embodiment, the switches SW41, SW42, SW43, SW21, SW22, SW23 can be realized by other kinds of devices. Please refer to FIG. 6, which shows another emergency traffic controller 200 according to another embodiment. In this embodiment, each of the switches SW41', SW42', SW43' of the source selection unit 140' and each of the switches SW21', SW22', SW23' of the target redirection unit 120' is a kind of transistor. The emergency traffic controller 200 can be operated in the normal mode or the emergency mode described above, and the similarities are not repeated here.

Base on the embodiments above, the emergency vehicle 700 can safely and quickly pass through the intersection, while the emergency traffic controller 100 or 200 is operated in the emergency mode. Further, the emergency traffic controller 100 or 200 can be set up without modifying the structure or the circuit design of the existing traffic light controller 900 and the traffic light sign 800, so the emergency traffic controller 100 or 200 can be adapted to any traffic light system in any country. Moreover, after the emergency vehicle 700 leaves, the emergency traffic controller 100 or 200 can return to the normal mode under the same lighting signal S1 provided from the existing traffic light controller 900.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An emergency traffic controller, comprising:

an emergency controlling unit used for receiving an emergency message and outputting a switching signal according to the emergency message;

a source selection unit electrically coupled to a traffic light controller; and a target redirection unit electrically coupled to the traffic light controller and the emergency controlling unit, wherein the target redirection unit is used for receiving an original lighting signal from the traffic light controller through the source selection unit and working with the emergency controlling unit to transmit the original lighting signal to one of a plurality of traffic light signs through a path created by the switching signal.

2. The emergency traffic controller according to claim 1, further comprising:

a source detection unit electrically connected to the traffic light controller and the emergency controlling unit, wherein the source detection unit is used for transforming the original lighting signal to be a direct-current voltage level;

wherein the emergency controlling unit is further used for generating a selecting signal to the source selection unit according to the original lighting signal, and the source selection unit is used for transmitting the original lighting signal to the target redirection unit according to the selecting signal.

3. The emergency traffic controller according to claim 2, wherein the source selection unit includes a plurality of switches, and the selecting signal is transmitted to one of the switches that the original lighting signal is transmitted.

4. The emergency traffic controller according to claim 3, wherein each of the switches is a magnetic switch or a transistor.

5. The emergency traffic controller according to claim 1, wherein the target redirection unit includes a plurality of switches, and the original lighting signal is transmitted to all of the switches, and the switching signal is transmitted to one of the switches.

6. The emergency traffic controller according to claim 5, wherein each of the switches is a magnetic switch or a transistor.

7. The emergency traffic controller according to claim 1, further comprising:

an emergency sensing unit communicating with the emergency controlling unit for detecting whether there is an emergency vehicle on a road and transmitting the emergency message to the emergency controlling unit if the emergency vehicle is detected.

8. The emergency traffic controller according to claim 7, further comprising:

a message transmitting unit for transmitting the emergency message and a notification message to another emergency traffic controller if the emergency controlling unit receives the emergency message.

9. The emergency traffic controller according to claim 7, further comprising:

a message receiving unit for receiving the emergency message and a notification message from another emergency traffic controller which detects the emergency vehicle.

10. The emergency traffic controller according to claim 7, further comprising:

an emergency direction display for displaying a moving direction of the emergency vehicle according to the emergency message.

11. A controlling method of an emergency traffic controller, comprising:

receiving an original lighting signal from a traffic light controller;

receiving an emergency message;

outputting a switching signal according to the emergency message; and transmitting the original lighting signal to one of a plurality of traffic light signs through a path created by the switching signal.

12. The controlling method of the emergency traffic controller according to claim 11, further comprising:

transforming the original lighting signal to be a direct-current voltage level;

generating a selecting signal according to the original lighting signal;

transmitting the original lighting signal according to the selecting signal.

13. The controlling method of the emergency traffic controller according to claim 12, wherein the selecting signal is transmitted to one of a plurality switches that the original lighting signal is transmitted.

14. The controlling method of the emergency traffic controller according to claim 13, wherein each of the switches is a magnetic switch or a transistor.

15. The controlling method of the emergency traffic controller according to claim 11, further comprising:

detecting whether there is an emergency vehicle on a road; and generating the emergency message if the emergency vehicle is detected.

16. The controlling method of the emergency traffic controller according to claim 15, further comprising:

transmitting the emergency message and a notification message to another emergency traffic controller if the emergency message is generated.

17. The controlling method of the emergency traffic controller according to claim 15, further comprising:

receiving emergency message and a notification message from another emergency traffic controller which detects the emergency vehicle.

18. The controlling method of the emergency traffic controller according to claim 15, further comprising:

displaying a moving direction of the emergency vehicle according to the emergency message.

* * * * *